US005868647A

United States Patent [19]

Belsole

[11] Patent Number: 5,868,647

[45] Date of Patent: Feb. 9, 1999

[54] APPARATUS AND METHOD FOR REDUCING REPETITIVE STRAIN INJURIES

[76] Inventor: Robert J. Belsole, 1033 Guisando De Avila, Tampa, Fla. 33613

[21] Appl. No.: 891,948

[22] Filed: Jul. 14, 1997

[51] Int. Cl.[6] ..... A63B 21/00

[52] U.S. Cl. ..... 482/8; 482/1; 482/4; 482/901; 482/44; 434/229; 702/176; 601/33; 601/40

[58] Field of Search ..... 482/1–9, 900–902, 482/44–47; 434/247, 256–258, 219, 227–233; 345/156–172; 702/41, 176; 601/33, 40; 602/61, 64, 21; 400/489, 480, 481

[56] References Cited

U.S. PATENT DOCUMENTS

| | | | |
|---|---|---|---|
| 4,807,642 | 2/1989 | Brown . | |
| 4,918,560 | 4/1990 | Storer . | |
| 5,137,384 | 8/1992 | Spencer et al. . | |
| 5,161,760 | 11/1992 | Terbrack . | |
| 5,305,238 | 4/1994 | Starr et al. | 702/176 |
| 5,311,210 | 5/1994 | O'Brien et al. . | |
| 5,366,436 | 11/1994 | Gibney . | |
| 5,398,896 | 3/1995 | Terbrack . | |
| 5,413,553 | 5/1995 | Downes . | |
| 5,441,058 | 8/1995 | Fareed . | |
| 5,492,525 | 2/1996 | Gibney . | |
| 5,501,657 | 3/1996 | Feero . | |
| 5,522,323 | 6/1996 | Richard . | |
| 5,538,431 | 7/1996 | Dempster . | |
| 5,551,933 | 9/1996 | Washburn . | |
| 5,567,067 | 10/1996 | Ambrose . | |
| 5,579,238 | 11/1996 | Krugman | 702/41 |
| 5,581,277 | 12/1996 | Tajiri . | |
| 5,745,376 | 4/1998 | Barker et al. | 702/41 |

OTHER PUBLICATIONS

Interface Technologies, Inc. advertisement entitled "DeskEx BodyAwareness Systems", 1997.

PC Dynamics, Inc. advertisement entitled Screen Play 2.01 for Windows, 1996.

ZDNet advertisement entitled "Workpace", 1997.

Donkin, Richard, "Typing Injury FAQ: Software Monitoring Tools", 1996.

Anderson, Bob, "Stretching At Your Computer or Desk", 1996.

*Primary Examiner*—Glenn E. Richman

*Attorney, Agent, or Firm*—Stein, Schifino & Van Der Wall

[57] ABSTRACT

An apparatus and method for reducing, preventing, lessening and treating the incidence and severity of Repetitive Strain Injuries ("RSI") comprising a combination of computer software and hardware that provides a "prompt" and system whereby the computer operator exercises their upper extremities during data entry and word processing thereby maximizing the excursion (range of motion) of the joints involved directly and indirectly in computer operation. In summary, the apparatus and method of the present invention includes 1) specialized target means with optional counters which serves as "goals" or marks towards which the hands of the typist are directed during prolonged key entry, 2) software that directs the movement of the limbs to and from the keyboard, and 3) software that individualizes the frequency and intensity of the exercise sequence.

19 Claims, 10 Drawing Sheets

APPARATUS AND METHOD FOR REDUCING REPETITIVE STRAIN INJURIES

BACKGROUND OF THE INVENTION

1. Field of the Invention

This invention relates to repetitive strain injuries and, more particularly, to a method and apparatus for lessening the incidence and severity of repetitive strain injuries for those who frequently utilize a computer keyboard and mouse.

2. Description of the Background Art

Repetitive Strain Injuries (hereinafter "RSI") is an umbrella term which refers to strain injuries of the neuromusculoskeletal system. This syndrome may also be referred to as cumulative trauma disorder, repetitive use injuries, repetitive motion injuries, repetitive movement injuries or occupation overuse syndrome. RSI presumably result from fine fast repetitive activities which adversely affect the hands, wrists, forearms, elbows, arms and shoulders of one or both upper extremities. For instance, it is believed that repeatedly twisting and turning the wrist and pronating and supinating the forearm may result in this type of injury. While the exact nature or cause of this syndrome is not known, repeated keystrokes, long periods using peripheral computer devices such as mice, trackballs etc. are felt to damage the soft tissues of the extremities. In short, any activity that puts repeated or prolonged strain on the hands and wrists is thought to be cumulative and harmful. Static holding or fine hand tracking is also harmful.

Carpal tunnel syndrome or compression/injury of the median nerve in the wrist [carpus] is the most publicized RSI but not the only one. Tendinitis, tenosynovitis, capsulitis, myositis, neuritis, bursitis and epicondylitis are other related terms used interchangeably with the condition. In the past RSI has been frequently seen in musicians, scanners, splicers, meat cutters, sheep shearers and in other trades which employ fine repetitive movements of the hands for long periods. However, the explosion of the "information age", with the attendant increase in keying and data entry, has focused many health problems on the computer workstation.

The incidence of RSI is believed to increase when a computer operator (i.e., a secretary or data entry personnel) repeats the same movement countless times a day. For instance, if during typing a computer operator keys an average of five (5) keystrokes per word×60 words per minute this equals approximately 300 keystrokes per minute which on average equals roughly 18,000 keystrokes per hour.

Major symptoms include pain anywhere in the limb, numbness and tingling in the hands, clumsiness, heaviness, loss of coordination and strength in the hands, night pain and numbness, and tightness and stiffness in the upper limb(s). Physical signs included tender muscles and joints, loss of sensibility, increased coolness and sweating, decreased strength, motion and dexterity. For the most part, there is an absence of gross and microscopic inflammatory findings and characteristically most of the signs and symptoms fail to improve with conventional treatments. RSI may temporally respond to rest, splints, exercises and changes in position but the syndrome often returns quickly with the resumption of activity. End stages of the condition may be associated with symptoms which fail to improve with rest.

The cost associated with RSI in the workplace is significant. There is loss of productivity, compensated time out of work, bills for direct and indirect medical care, legal expenses for administering claims, expenses for employee retraining, increased indemnity and worker's compensation insurance.

Continued efforts are being made to change computer keyboards, peripherals and methods to reduce RSI. Consider background patents which illustrate, for example, the large number of keyboard and "mouse" devices designed to reduce and lessen the incidence of RSI such as in U.S. Pat. No. 5,581,277 to Tajiri; U.S. Pat. No. 5,567,067 to Amborse which teaches a keyboard positioning system;

U.S. Pat. Nos. 5,161,760 and 5,398,896 to Terbrack teach keyboard forearm, wrist and hand support devices for use in conjunction with the keyboard of a computer which are designed to reduce stress on the user's shoulders, arms, wrists and hands. Using an external mouse or input device may remove at least one hand from the keyboard at a time, however, the fine status control required to manipulate these devices mimics the original injurious environment.

In addition, "ergonomic" devices designed to decrease repetitive strain injuries are disclosed in a number of patents. By way of example, note U.S. Pat. No. 5,137,384 to Spencer et al.; U.S. Pat. No. 5,522,323 to Richard; and U.S. Pat. No. 5,311,210 to O'Brien et al. Furthermore, many large computer companies ship printed and/or on-line user guides which describe RSI symptoms and suggest alternatives including ergonomic changes.

Another grouping of background patents are those which disclose treatment methods and apparatus for treating common RSI such as carpal tunnel syndrome. By way of example, note U.S. Pat. No. 5,551,933 to Washburn; U.S. Pat. Nos. 5,366,436 and 5,492,525 to Gibney; U.S. Pat. No. 5,441,058 to Fareed; U.S. Pat. No. 5,413,553 to Downes; and U.S. Pat. No. 5,501,657 to Feero. The patent to Feero teaches a method of alleviating carpal tunnel syndrome that is directed to a therapeutic manipulative method that in part reduces the inflammation and increases circulation about the flexor cavity.

There is software currently available, which through use of sound or screen messages monitors key activity and reminds the computer operator to take a break or stop data entry. Some of these software programs even "suggest" and illustrate exercises that a computer operator should perform at their station. Additionally, there are programs and company policies which strongly urge or mandate that computer operators periodically exercise and stretch after a given duration (usually after a half or full hour of input). Additionally, these software programs usually impose a break based upon either entry time or work. However, tracking work/clock time is not constant and influenced by many factors (i.e. comfort adjustments and telephone breaks). Additionally, none of the available software is designed to be utilized in conjunction with a specialized target mounted to a computer monitor.

There are many ergonomic devices available, and ergonomic consulting services which recommend flexing the wrists slightly with pads or slants which are affixed to or proximal to the keyboard, however, these devices rarely help because the computer operator continues to statically position their limbs.

While these programs and policies may aid somewhat in lessening the likelihood of RSI they do not address the root of the problem, specifically, compelling the computer operator to regularly remove their hands from the keyboard and carry out a series of exercises designed and timed to alleviate and prevent RSI.

Lastly, U.S. Pat. No. 4,807,642 to Brown teaches a monitoring device that detects muscle strain and triggers an acoustic signal to indicate when an undesirable strain condition exists. U.S. Pat. No. 5,538,431 to Dempter teaches typing and mouse manipulation techniques and the methods for teaching these techniques which are designed to avoid repetitive strain injuries. The techniques taught by this patent are very complex and require the typist to constantly monitor and self-adjust the positioning of their hands, wrists and arms. Specifically, the second step of this method is that the typist strikes individual selected keys using coordinated finger, hand, wrist and arm movements approximately in the midrange of joint articulation, including, as required to strike a selected key. The patent to Dempster names these "leap frog type hand and arm", "swinging arm" or "in and out hand and arm" movements. However, the techniques taught by this patent are complicated and would not only require a great deal of instruction but in all likelihood would be readily abandoned by an individual typist because they require a typist to relearn typing skills and essentially start from square one. Also, the efficiency of these patents is directed to joint position at key impact rather than mobilizing the joints to improve their biological environment.

Efforts to improve the methods and apparatus to reduce RSI continue. The method and apparatus of the present invention is based upon the assumption that continuous and static hand and limb positioning at the computer terminal produces an unhealthy physiological environment for the upper anatomy. The apparatus and method of the present invention emphasizes the beneficial effects of active movement of human upper joints in conjunction with cessation of input activities. Specifically, the apparatus and method of the present invention prompts the computer operator to increase the mobility of their upper joints. Joint motion requires active muscle contraction. This physiologically mobilizes all para-articular soft tissues especially peripheral nerves which without such stimuli become static, abnormally sensitive and produce pain, numbness and hypersensitivity. These upper joint movements are needed continually and regularly during key input. Hourly breaks and daily exercise programs are far from ideal and are generally used as rest periods without proper active exercises.

Accordingly, it is an object of the invention to provide an improvement that overcomes inadequacies of the prior art devices and provides an improvement, which is a significant contribution to the advancement of the art.

Another object of the invention is to provide an apparatus and method to reduce the incidence of RSI in computer operators.

A further object of the invention is to provide an apparatus and method to prevent RSI in computer operators.

A further object of the invention is to provide an apparatus and method to lessen RSI in computer operators.

A further object of the invention is to provide an apparatus and method to treat RSI in computer operators.

A further object of the invention is to provide a new apparatus and method which direct the computer operator to exercise both upper extremities during data input.

A further object of the invention is to provide and apparatus and method which prompts the computer user to physically remove their hands from the computer keyboard and execute a sequence of exercises designed to maximize the mobilization of the joints of the upper extremities.

A further object of the invention is to provide a new apparatus and method which may be utilized in conjunction with already available commercial products and ergonomic adjustments.

A further object of the invention is to provide an apparatus and method for reducing the incidence of RSI which does not greatly reduce employee productivity, require a great deal or training or deviate from known methods of data entry.

A further object of the invention is to provide a method which can be readily modified to prevent, alleviate and improve RSI symptoms in all age groups.

The foregoing has outlined some of the pertinent objets of the invention. These objects should be construed to merely be illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detained description of the preferred embodiment in addition to the scope of the invention defined by the claims taken in conjunction with the accompanying drawings.

SUMMARY OF THE INVENTION

For the purposes of summarizing the invention, the invention comprises a combination of computer software and hardware that provides a "prompt" and system whereby the computer operator exercises their upper extremities during data entry and word processing thereby maximizing the excursion (range of motion) of the joints involved directly (i.e. wrists) and indirectly (i.e. shoulders) during computer operation. Specifically, the apparatus and method of the present invention is drawn to the prevention, lessening and treating of RSI in computer operators.

For instance, computer entry people generally lock their upper limbs in static positions for long periods of time which may lead to or aggravate RSI. For purposes of discussion, it will be assumed that the operator is right-handed and will use a computer peripheral (i.e. mouse or trackball) which is positioned to the right of the keyboard.

The focus of the apparatus and method of the present invention is to harmonize the movements of the shoulder, elbow, forearm and wrist joints during word processing and data entry. The forearm has two joints, one just below the elbow and the other at wrist level. Movement of the muscles at these joints creates a range of motion at these joints that until now have been ignored in discussions and treatments related to RSI. First, supination of the forearm rotates the palm upward (right palm clockwise) while pronation designates the opposite movement and rotates the palm to face and parallel the floor (right palm counter clockwise). Generally speaking, these movements are lessened by shoulder joint compensation. Additionally, during word processing and data entry, hand position and range of motion is controlled by the position of the wrist during keying or stroke input. Harmful static prolonged positioning does not impact the hands, thumbs or digits since they are always continually in motion during word processing or data input.

As general background, and to aid in the understanding of the drawings, method and apparatus of the present invention, a brief discussion of the motion allowed by Synovial Joints (found at all articulations of the limbs) is provided. It must be born in mind that these are average range or arc of motion only, some individual's joints are more flexible while others are less so. Abduction occurs when the shoulder joint moves the limb away from the body midline while adduction is the movement towards the body midline. Extension is to straighten limbs at a joint while flexion is to bend limbs at the joint. Pronation occurs when the forearm is placed palm down and supination is to turn the forearm to place palm up. Internal rotation is to move the limb inward on a central axis while external rotation refers to the outward movement of the limb on a central axis. To fully understand the apparatus and method of the present invention, it is useful to classify and designate the upper extremity joints (i.e. shoulders, elbows, forearms and wrists) in three-dimensional space.

Normal Joint Movement

With the arms at the sides of the trunk, the shoulder abducts the arm away from the trunk of the body and adducts toward the midline of the truck. The range of motion is approximately 90° from 0° adduction to 90° abduction. The shoulder extends forward in front of the trunk and flexes backward behind the trunk. This range of motion is approximately 150°. With the arms at the sides of the trunk the shoulder internally rotates the arm (towards) and externally rotates the arm (away) from the midline. Internal and external rotation of the shoulders with arms abducted 90° from the trunk, will not be discussed herein.

The forearm rotates about an axis that runs longitudinally from the middle finger to the elbow. Full supination is noted by the palm being fully up and facing the ceiling. When the forearm is rotated and the palm faces the floor, full pronation has been achieved. The average total range of motion for the forearm is supination (80°) to pronation (80°) with a total arc of forearm rotation equal to 160°. With the arms held at the trunk of the body, the shoulder rotates externally (45°) and internally (45°) for a total arc of motion of approximately 90°.

The elbow flexes when the forearm closes the angle with the upper arm and extends when the angle decreases to zero (straight). The range of motion is 0° (fully extended) to 110° (fully flexed).

The wrist extends when the back of the hand approaches the back of the forearms and flexes when the palm moves in the opposite direction. The average total range of motion for the wrist is 70° extension and 70° flexion with a total arc of motion equal to 140°. The wrist joint also deviates ulnarly towards the small finger and radially toward the thumb. The arc of motion (deviation) is roughly 45°. The range of motion for this ulnar movement is much more extensive (30°) than the radial movement (15°).

The shoulder is fixed in terms of abduction/adduction and forward/backward elevations. Rotary movements at the shoulders are minimal as computer operators often utilize deviation of the wrists to span the keyboard or manipulate the mouse. The elbow is almost always at the 90° flexed static position. When the computer operator switches mode of input from the keyboard to the mouse, some external rotation of the arm at the shoulder occurs. Forearm rotational movement does not change significantly during computer entry operations and the wrists position tend to only change in a side-to-side (radial-ulnar) deviation. Even when the digits move rapidly to strike the keys there is little wrist flexion or extension observed. In summary, when utilizing "traditional" keying and typing techniques minimal movement occurs in the larger joints of the upper extremities during rapid keying.

Restricted Joint Movement During Data Input

Table 1. illustrates the rather limited joint movements involved in keyboard entry.

TABLE 1

| MOVEMENT | ARC OF MOTION (Deg) | KEYING USE (Deg) | USE (%) |
|---|---|---|---|
| shoulder rotation | 90 | 15 | 17 |
| shoulder abduction/adduction | 90 | 20 | 22 |
| shoulder extension/flexion | 150 | 30 | 20 |
| elbow extension/flexion | 110 | 25 | 23 |
| forearm rotation | 170 | 10 | 6 |
| wrist extension/flexion | 140 | 35 | 25 |
| wrist radioulnar deviation | 45 | 15 | 33 |

The arcs of motion data provided are averages only and will vary depending on an individual's musculature and muscular elasticity. Additionally, the data pertaining to the degree of motion of the joints during key entry are averages. Different postures, hand positions, chair and desk positioning and input techniques may increase a particular joint(s)' degree of motion but will conversely limit the range of motion in another joint(s). For example, if a keyboard is positioned below the level of the flexed elbow (90°), the elbows will extend more and the wrists will flex much more and will not extend past neutral (0°).

On the most important considerations in the etiology of RSI is the negative effect of repetitive movement and static hand positioning on the micro-circulation of muscles, nerves, joint capsules and tendons. It is believed that the static holding and repeated contractions required in these activities, the tension (increased tissue pressure) produced and the electroactivity generated, impedes circulation into soft tissues and restricts the flow of nutrients to the system. Good circulation is also needed to rid waste products from the system. Active joints mobilize soft tissues and directly pump nutrients in and out and indirectly create differential gradients that enhance biological exchange.

Theories regarding the adverse results of static hand positioning in keyboard activity is supported by the fact that "traditional" use of typewriters rarely produced this condition. Presumably, alternate movements such as carriage return and paper insertion required interrupted the cycle. Ergonomics also point to the beneficial effect of the upright keyboard on typewriters but this has not been supported by an equal improvement using one of the many keyboard modifications. Laptop users also don't usually experience symptoms as the data entry pool since laptop use is more for management and financial tasks which generally entail less static positioning of the hands and less continuous keying time.

Therefore, in order to reduce the incidence of RSI it is necessary to provide an impetus for the computer operator to cease typing or data entry and deviate from the static position of the upper joints during computer word processing and data processing. Specifically, the present invention comprises an apparatus and method that provides a signal stimulus for the computer operator to remove their hands from the keyboard and carry out a series of exercises designed and timed to alleviate and prevent RSI. Furthermore, the apparatus and method of the present invention utilizes specially designed target means which are mounted to the computer monitor which aid in defining the trajectory of the computer operator's hands during the exercises.

In summary, the apparatus and method of the present invention includes 1) specialized target means with optional counter means which serve as "goals" or marks towards which the hands of the typist are directed during prolonged key entry, 2) software that directs the movement of the limbs to and from the keyboard, and 3) software that individualizes the frequency and intensity of the exercise sequences.

Advantageously, the apparatus and method of the present invention permits the alleviation and prevention of RSI without requiring extensive retraining of computer operators, nor significantly decreasing the productivity of computer operators. The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the invention. It should also be realized by those skilled in the art that such equivalent constructions do not depart form the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several view of the drawings.

DETAILED DESCRIPTION OF THE PREFERRED EMBODIMENT

While it remains unclear exactly how the apparatus and method of the present invention performs, it is probable that the utilization of forced breaks with a programmed exercise program used in conjunction with a specially oriented target means increases joint movement, and mobilize tissues which improves local physiology thereby providing a means to prevent, lessen and treat RSI. For purposes of this discussion, it is presumed that the computer operator is sitting erect with the monitor at eye level.

Figure 1:
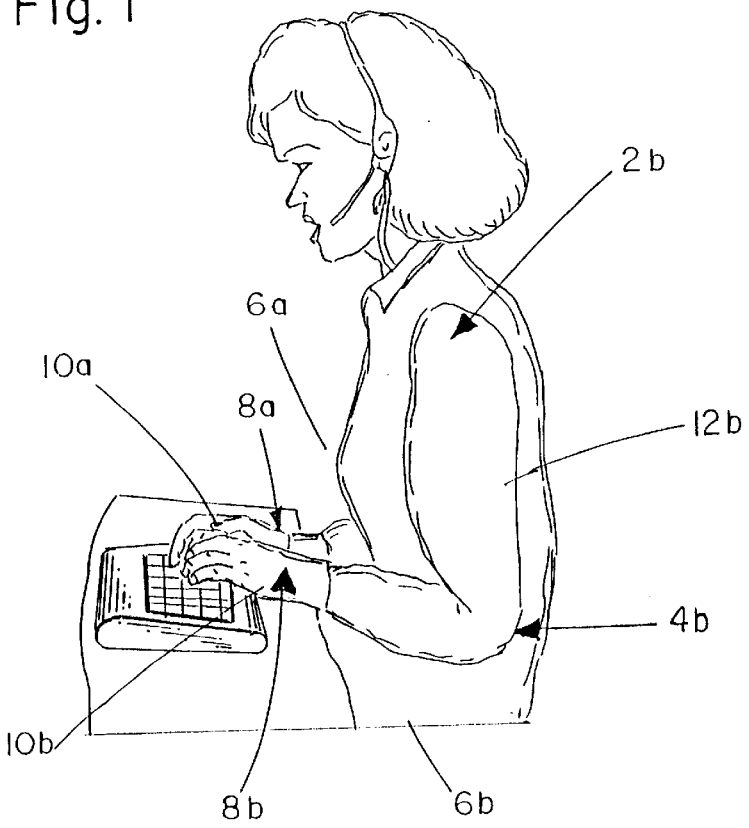
FIG. 1 is a side elevational view of a keyboard and typist illustrating the Ergonomic Computing Keyboard Position (ECKP)
Figure 2:
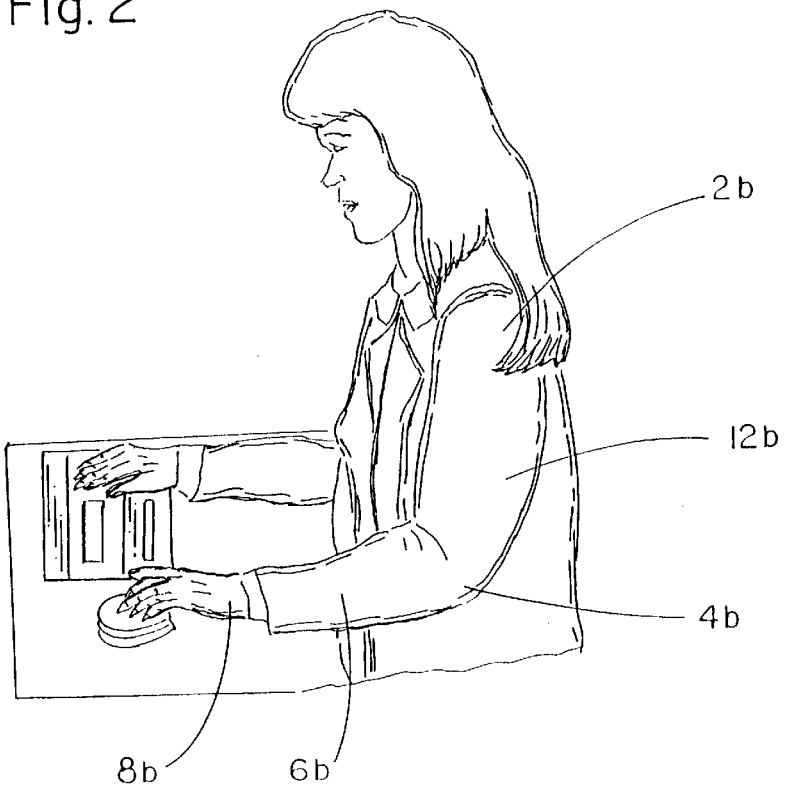
FIG. 2 is a side elevational view of a keyboard and typist illustrating the Ergonomic Computing Mouse Position (ECMP)

FIGS. 1 and 2 represents what the inventor has termed the Ergonomic Computing Keyboard Position (hereinafter "ECKP") and the Ergonomic Computing Mouse Position (hereinafter "ECMP") respectively. It is noted that these are not established ergonomic references, rather, these anatomic positions serve as a baseline from which movements can be studied during the implementation of the apparatus and method of the present invention.

ECKP and ECMP represent the static position of the upper joints during computer word processing and data processing. For purposes of discussion, the designation "a" will refer to the computer operator's right-side extremities while the designation "b" will refer to the computer operator's left-side extremities. As illustrated in FIG. 1, in the ECKP, the shoulders 2*a* (not shown) and 2*b* are internally rotated to bring the hands 10*a* and 10*b* to the midline of the keyboard. The elbows, 4*a* (not shown) and 4*b* are flexed 90° relative to the upper arms 12*a* (not shown) and 12*b* while the forearms 6*a* and 6*b* are fully pronated, palms face down. The wrists 8*a* and 8*b* which are in-line with the forearms 6*a* and 6*b,* deviate radially and ulnarly during input. In FIG. 2, in the ECMP, the shoulder 2*b* on the side of the body operating the mouse externally rotates and abducts slightly from the trunk 14 of the body. The elbow 4*b* on the mouse side remains flexed 90° relative to the arm 12*b*. The forearm 6*b* remains fully pronated and palm facing down. The wrist 8*b* on the mouse side deviates ulnarly slightly.

In ECKP and ECMP the wrists are at the same level of the forearm (approximately 0° wrist extension), the wrist joints may deviate inward (radially) towards the center of the keyboard or outwardly (ulnarly) toward the right and left boundary of the keyboard. In discussing the method and apparatus of the present invention, it is important to note that in ECKP and ECMP the forearm is fully pronated (i.e. palms down) and will not change during data entry or word processing. Any supinated movement of the forearms diminishes keying and mouse efficiency. In fact, there is a tendency by individuals to hyperpronate the forearms to bring the thumbs and digits into the center of the keyboard in an effort to maximize keyboard contact.

Target Means

Figure 3:
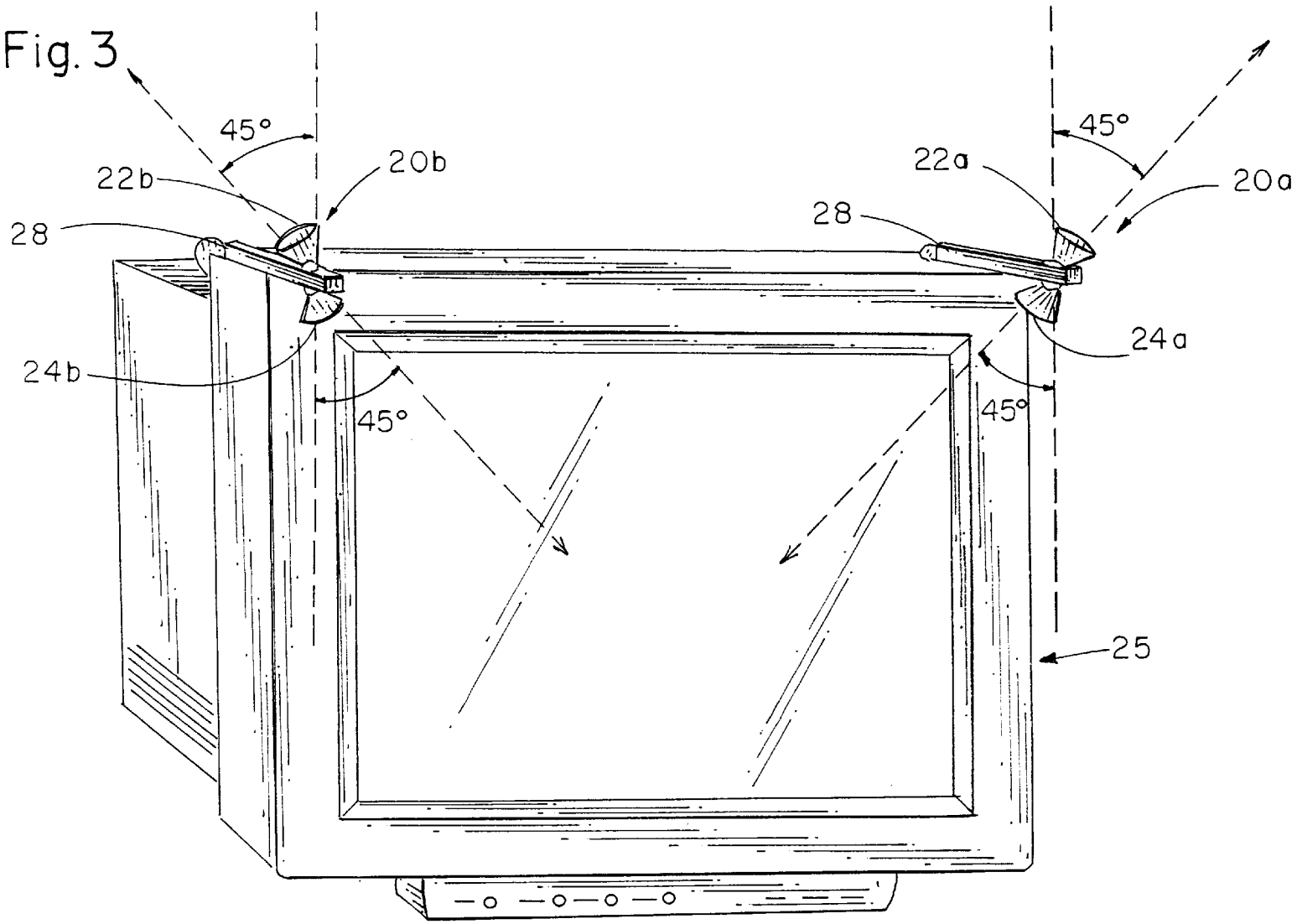
FIG. 3 is a plan view of a computer monitor with targets mounted at the upper right and left corners.

As illustrated in FIG. 3, target means (hereinafter "targets") 20*a* and 20*b* are attached at the angle between the top and side of the right and left corners respectively of the monitor 25 (as viewed by the computer operator when facing the monitor).

Figure 4:
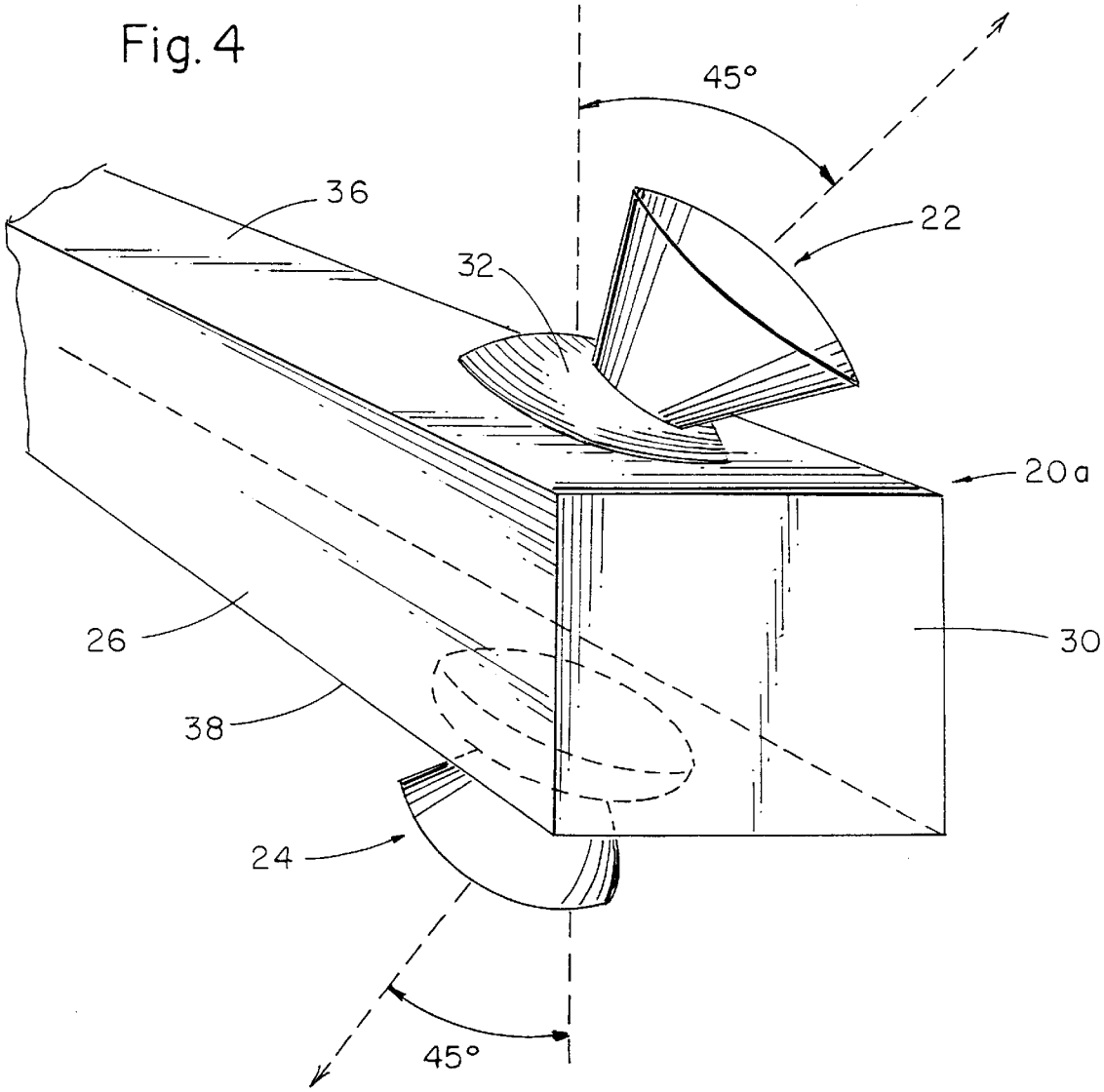
FIG. 4 is a detail of FIG. 3 illustrating a perspective view of a first embodiment of the upper-right target of the present invention.
Figure 5:
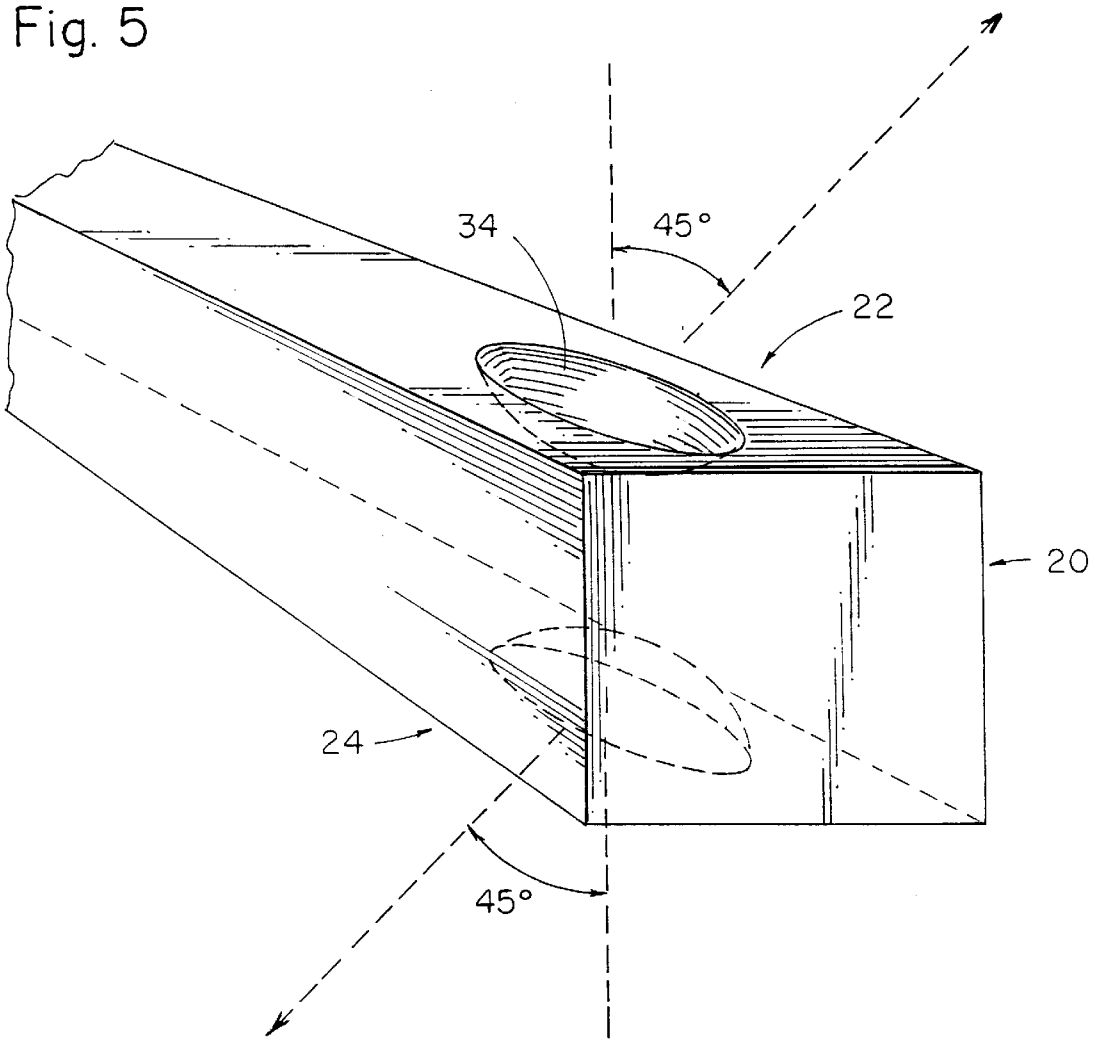
FIG. 5 is a detail view illustrating a perspective view of a second embodiment of the upper-right target of the present invention.

As best illustrated in FIGS. 4 and 5, which are detailed views of the right-side target 20*a,* the target of the present invention is structurally and mechanically rudimentary. The target may be constructed roughly in the shape of a rectangular parallelpiped (cuboid) or a cylinder. In simpler terms, the target of the present invention is an elongate member 26, having a first end 28 and a second end 30, and an upper 36 and lower surface 38, which extends outward from the plane of the monitor screen. The first end of the target is fixedly attached to a computer display monitor while the second end has a plurality of contact interfaces disposed thereon. More specifically, each target comprises an upper contact interface 22 disposed upon the upper surface 36 of the target means and a lower contact interface 24 disposed upon the lower surface 38 of the target means, opposite thereof towards which the computer operator directs their hands during a series of exercises. The actual targets and contact interfaces are fastened at specific angles that are important in defining the trajectory of the movement of the limb when it leaves the keyboard.

Figure 7:
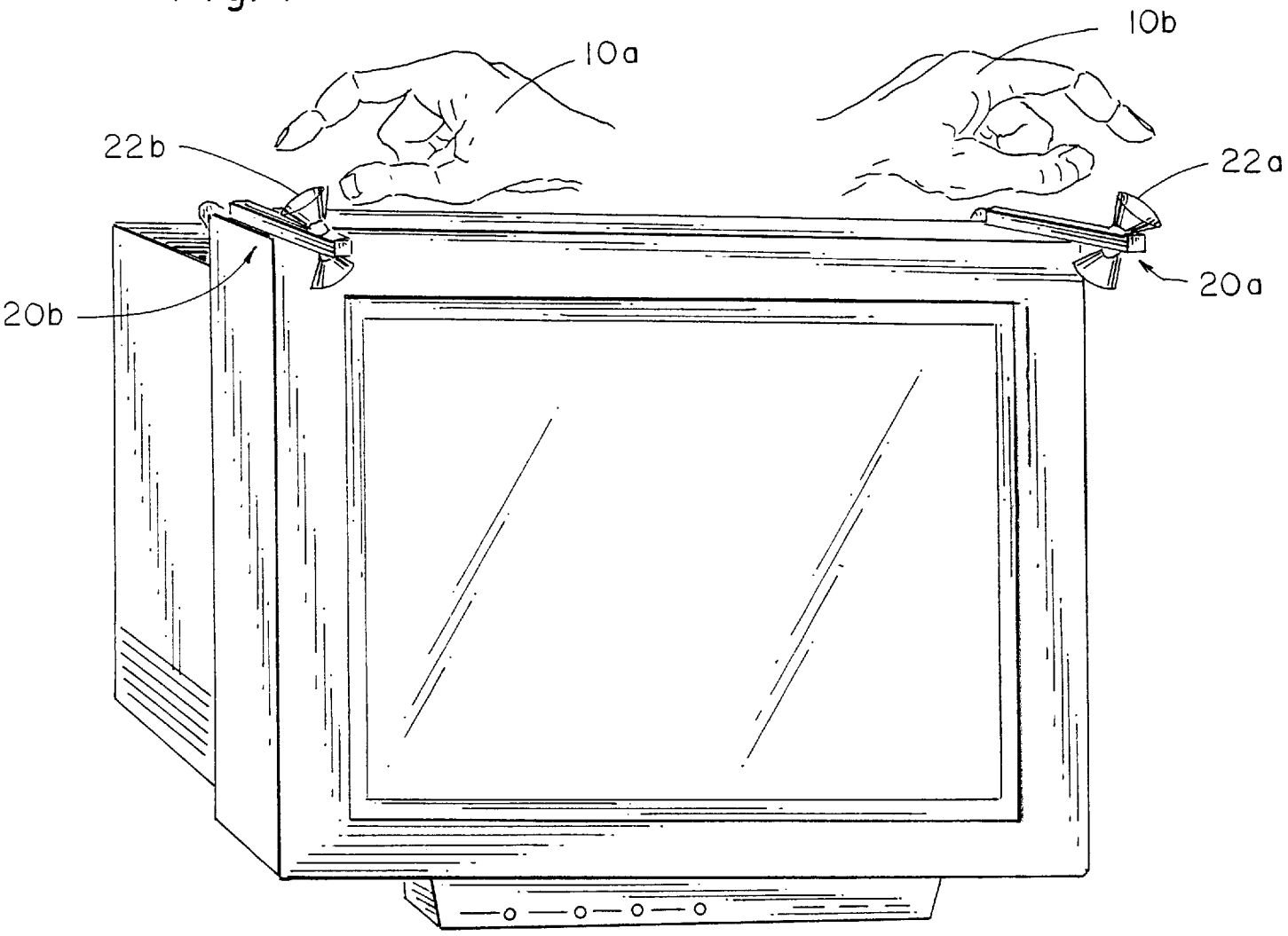
FIG. 7 is a plan view of a computer monitor with targets mounted at the upper right and left corners illustrating the movement of the hands relative to the upper contact interfaces.

As shown in FIG. 7, the upper contact interface 22*b* displaced on the left-side target 20*b* serves as the target for the right hand 10*a* of the computer operator. Similarly, the upper contact interface 22*a* on the right-side target 20*a* is the destination for the left hand 10*b* of the computer operator. The upper contact interfaces 22*a* and 22*b* for the most part are oriented to face the ceiling but are inclined 45° outward in the plane of the screen.

Figure 6:
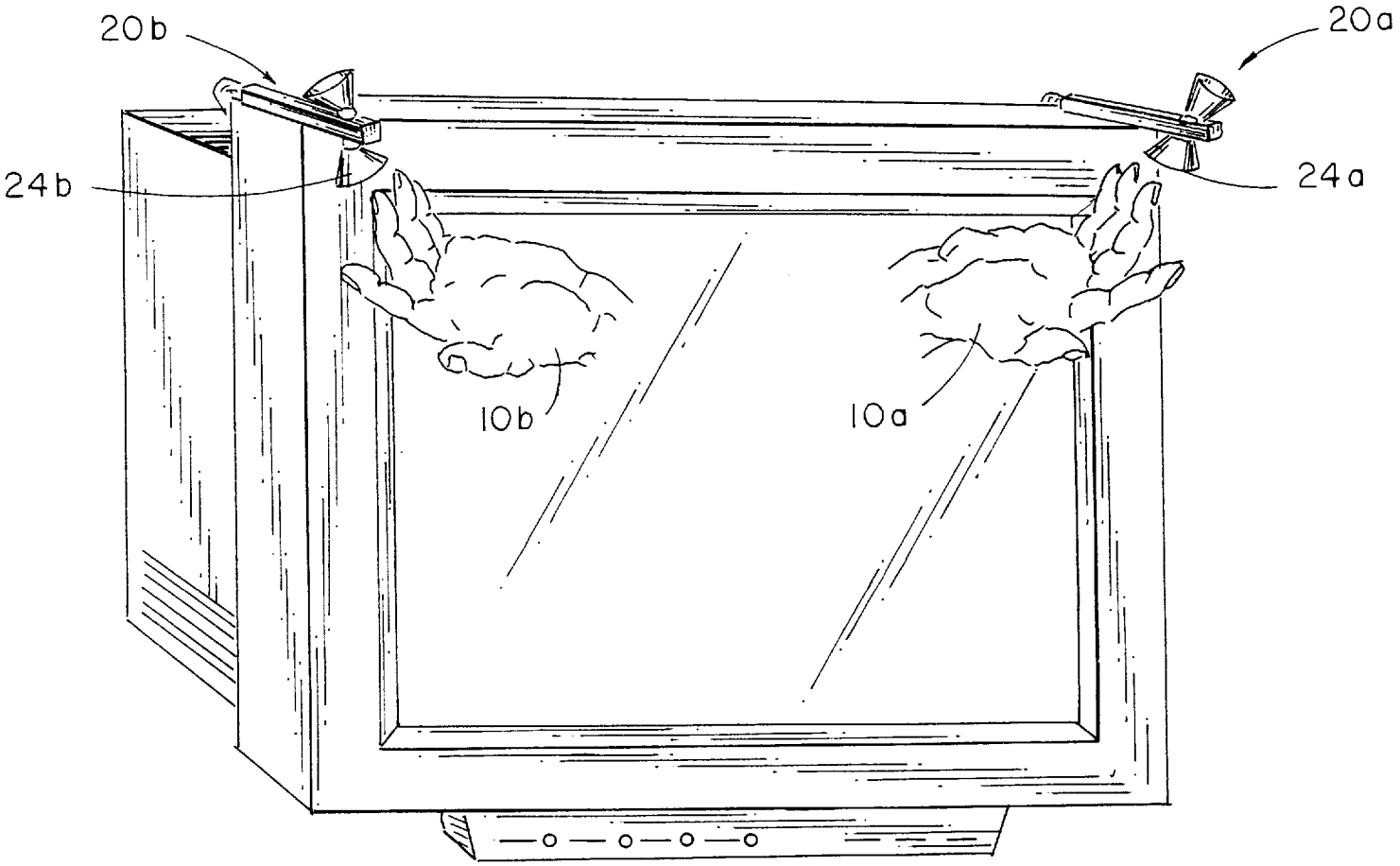
FIG. 6 is a plan view of a computer monitor with targets mounted at the upper right and left corners illustrating the movement of the hands relative to the lower contact interfaces.

Conversely, as illustrated in FIG. 6, the lower contact interface 24*b* displaced on the left-side target 20*b* serves as the target for the left-hand 10*b* of the computer operator and vise versa. Therefore, the operator's right hand 10*a* will strike the lower contact interface 24*a* of the right-side target 20*a* while the left hand 10*b* will touch the lower contact interface 24*b* of the left-side target 20*b*. Preferably, the lower contact interfaces are oriented 45° inward in the plane of the screen and also 45° toward the back of the screen/computer.

The horizontal distance from the right to the left-upper corners of the computer monitor is usually between 12" and 20", in those instances when the terminal is less than 16" across, the targets will extend outward as well as in front of the monitor. Preferably, the targets are sized to accommodate two to three finger pulp areas (i.e. fingertips) of the hand. The axial length of the elongate member is preferably three to six inches.

As illustrated in FIG. 4, the target and contact interfaces may be manufactured such that the elongate member and contact interfaces are separate components. As a further refinement, the contact interfaces may be pivotally mounted on a turret-shaped base 32 or utilize a ball and socket mount such that the angle and orientation of the contact interfaces may be adjusted and fine-tuned. Alternatively, as illustrated in FIG. 5, the elongate member and contact interfaces may be manufactured integrally (i.e. by injection molding) with the contact interfaces being recessed concave regions 34 on the surfaces of the elongate member. In an alternative embodiment (not shown), surface indicia may be applied to the elongate member.

The targets of the present invention may be fixedly attached to the computer monitor utilizing any method known in the computer pheriphal field. For instance, they targets may be secured by use of Velcro®, double-sided tape, brackets or support elements. Preferably, the targets are secured to such an extent that they can withstand impacts by the computer operator similar to the pressure or force applied to the carriage bar of a traditional typewriter. Preferably, the movement of the computer operator's extremities towards the targets should be controlled, relaxed with the contact pressure being relatively light.

As a further refinement, each target may incorporate a counter means (not shown) which registers the number of contacts by the computer operator. A reset switch may be utilized to return the counter to zero (0) or start. In practice, this counter could be utilized for self-monitoring and compliance with the apparatus and method of the present invention. Suitable counter mechanisms are well known and will not be discussed herein in detail.

In the present method and apparatus, one right-hand cycle is considered complete when the right hand 10*a* travels to the lower surface interface 24*a* of the right-side target 20*a* and at the next signal to the upper surface interface 22*b* of the left-side target. Similarly, one left-hand cycle is completed when the left hand 10*b* travels to the lower surface interface 24*b* of the left-side target 20*b* and then to the upper surface interface 22*a* of the right-side target. These left and right sequences occur sequentially. A sequence refers to the movement of one of the operator's hands to a target (i.e. right-hand to contact upper surface interface). As used herein one cycle equals two sequences.

Software Program

In the present apparatus and method the signals which prompt the computer operator to initiate the exercise cycle of their extremities are software directed. This software will run in the background, count keystrokes and provide an on-screen prompt to initiate a hand exercise cycle. Specifically, the software program directs the computer operator's hands toward the appropriate targets at designated intervals. If graphic capability is present the appropriate hand signal will be displayed in one of the four screen quadrants. The operators' hands simply follow the optical stimuli to the appropriate target. Systems which are not compatible with visual graphics will rely on text characters to direct the sequence of movements. The frequency of the cycle (discussed below) is variable and may be selected by the computer operator based upon considerations such as age, use, and previous and existing RSI symptoms. For instance, the frequency of the cycle may vary depending on whether the apparatus and method of the present application is being utilized to prevent, lessen or treat the RSI in a particular individual. As shown in Table 3, if an individual currently suffers from RSI symptoms, the frequency of the cycle will be more often.

Computer software programs which serve as typing break reminders and keystroke counters are well known in the industry and will not be discussed at length herein. Specifically, there is already commercially available software that is designed to count keystrokes, trigger a break or "lock-up" the computer keyboard. One skilled in the computer art could readily design a computer program to meet the requirements and criteria of the present application. Preferably, the software utilized in the present application will be programmable to override the exercise queue if desired.

Table 2 illustrates the increase in range of motion and percent of total motion achieved with the apparatus and method of the present invention. In this context, one cycles equals two sequences of the right hand.

TABLE 2

| Movement | ARC OF MOTION (Deg) | KEYING USE (Deg) | USE (%) | One Hand cycle range of motion completed (deg) | Percentage of the total motion (%) |
|---|---|---|---|---|---|
| shoulder rotation | 90 | 15 | 17 | 85 | 94 |
| shoulder abduction/adduction | 90 | 20 | 22 | 80 | 89 |
| shoulder extension/flexion | 150 | 30 | 20 | 120 | 80 |
| elbow extension/flexion | 110 | 25 | 23 | 75 | 83 |
| forearm rotation | 170 | 10 | 6 | 170 | 100 |
| wrist extension/flexion | 140 | 35 | 25 | 125 | 89 |
| wrist radioulnar deviation | 45 | 15 | 33 | 35 | 78 |

Specifically, the two columns on the far right demonstrate the extent of the upper joints' movement when using the apparatus and method of the present invention. As previously discussed, and shown in the left three columns, typical computer input movements (i.e., keying) moves the upper joints and extremities very little (left three columns) and this relative static environment usually continues until the operator stops and changes position, exercises or stretches. The above-referenced table demonstrates the beneficial joint movement that can be achieved in one cycle utilizing the apparatus and method of the present invention. Since the completion of a cycle is software prompted and timed, the computer operator will complete numerous cycles during word processing or data input thereby realizing the favorable cumulative effect of increasing joint movement at regular intervals. The final component of the apparatus and method of the present invention is to define the signal for and timing of the exercise prompt.

Timing/Frequency

As evidenced in Table 2, by utilizing the apparatus and method of the present invention, a computer operator may greatly increase the movement of the joints of the upper extremities in one cycle. The timing and frequency of the exercise queue is based on three variables: 1) number of keystrokes; 2) age of the computer operator and the 3) keying health status of the operator (i.e. symptom grade).

Keystrokes are an objective variable and easy to compute. A keystroke is defined as any contact with the keyboard which produces a response, whether visible on the screen or not (i.e. "shift", "delete" and "return"). The present method is based upon a benchmark unit of 75 keystrokes. However, it is well within the skill of someone in the art to modify the sequence for the exercise pattern as discussed herein and illustrated in Tables 3.

The second variable is the age of the computer operator. Computer operators <20–35 years are classified as age class CI. Computer operators' 35–50 years are classified as age class CII. Computer operators >50 years are classified as age class CIII.

The final variable measures the keying health status of the operator (i.e. symptom grade). A computer operator who has never had repeating and persistent hand pain, numbness and night symptoms is classified as Grade 1. Grade 2 designates operators who have daily symptoms of hand pain, numbness and night symptoms. Grade 3 is reserved for operators who have these symptoms almost all the time or immediately upon or shortly after keyboard activity. The initiation of a right or left-hand sequence is therefore dependent upon the number of keystrokes, age of the computer operator and symptom grade. Therefore, as evidenced in Table 3, older and more affected operators will complete right and left-hand cycles sooner and after less input volume (keystrokes). Younger and less symptomatic operators will input or key longer before completing a cycle.

TABLE 3

| | GRADE 1 | GRADE 2 | GRADE 3 | KEY HEALTH |
|---|---|---|---|---|
| AGE C I | 300 (4 lines) | 225 (3 lines) | 150 (2 lines) | |
| AGE C II | 150 (2 lines) | 150 (2 lines) | 75 (1 line) | |
| AGE C III | 75 (1 line) | 75 (1 line) | 75 (1 line) | |
| AGE | | | | |

On average, two cycles of hand movements will be completed based upon the schedule illustrated in Table 4

TABLE 4

| | GRADE 1 | GRADE 2 | GRADE 3 | KEY HEALTH |
|---|---|---|---|---|
| AGE C I | 1200 (16 lines) | 900 (12 lines) | 600 (8 lines) | |
| AGE C II | 600 (8 lines) | 600 (8 lines) | 300 (4 lines) | |
| AGE C III | 300 (4 lines) | 300 (4 lines) | 300 (4 lines) | |
| AGE | | | | |

Figure 8:
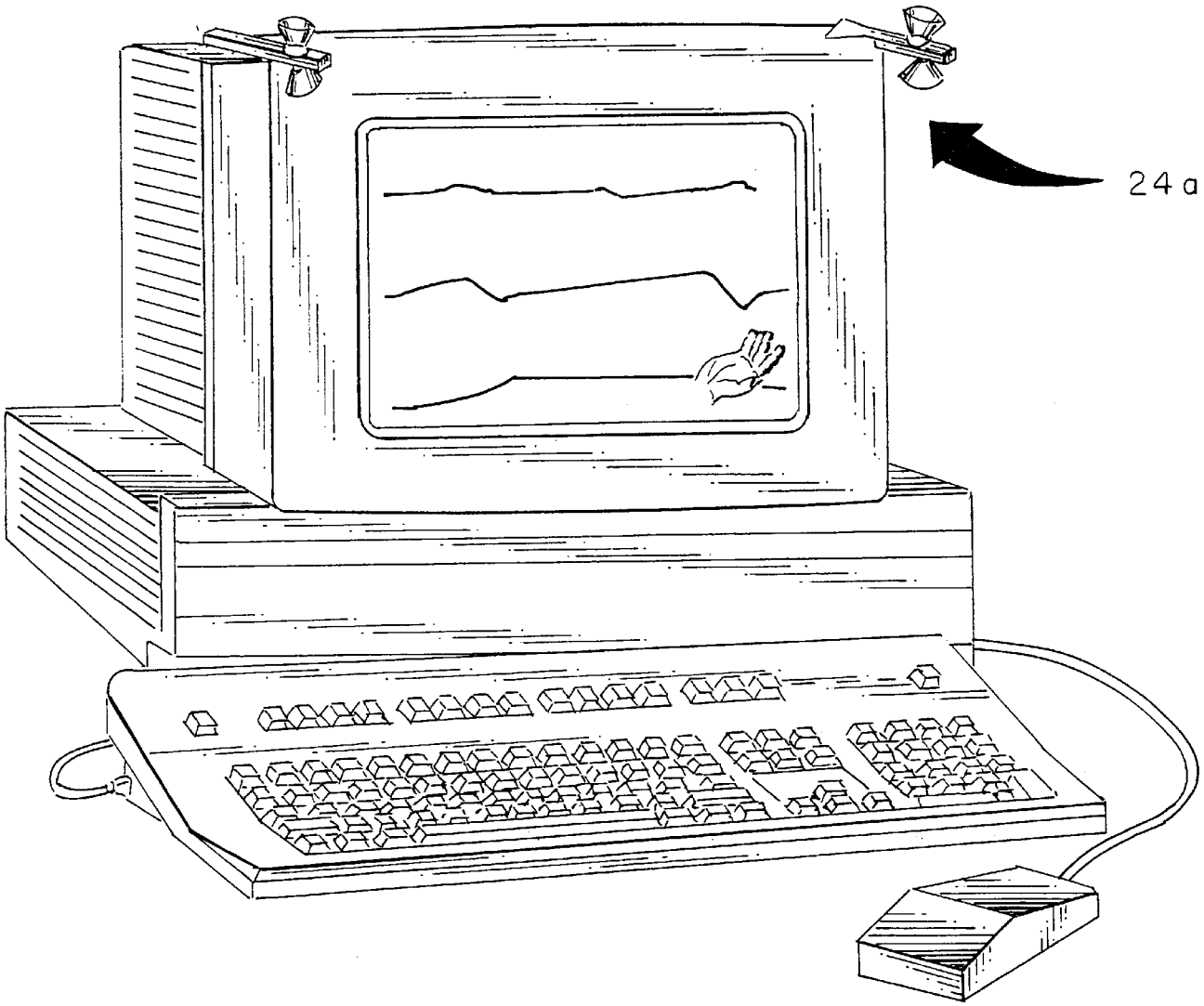
FIGS. 8–11 are schematics representations of the sequence exercises.
Figure 9:
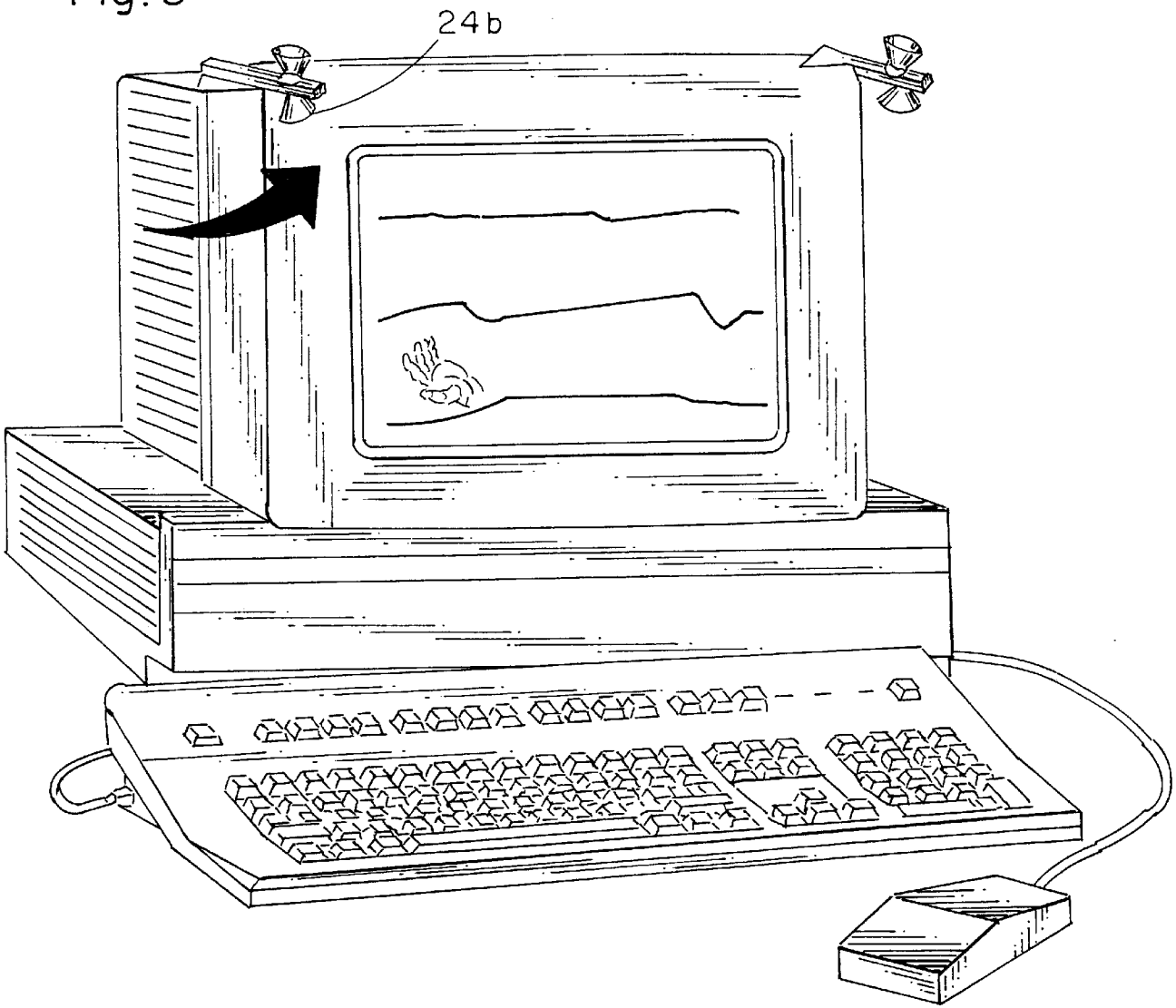
Figure 10:
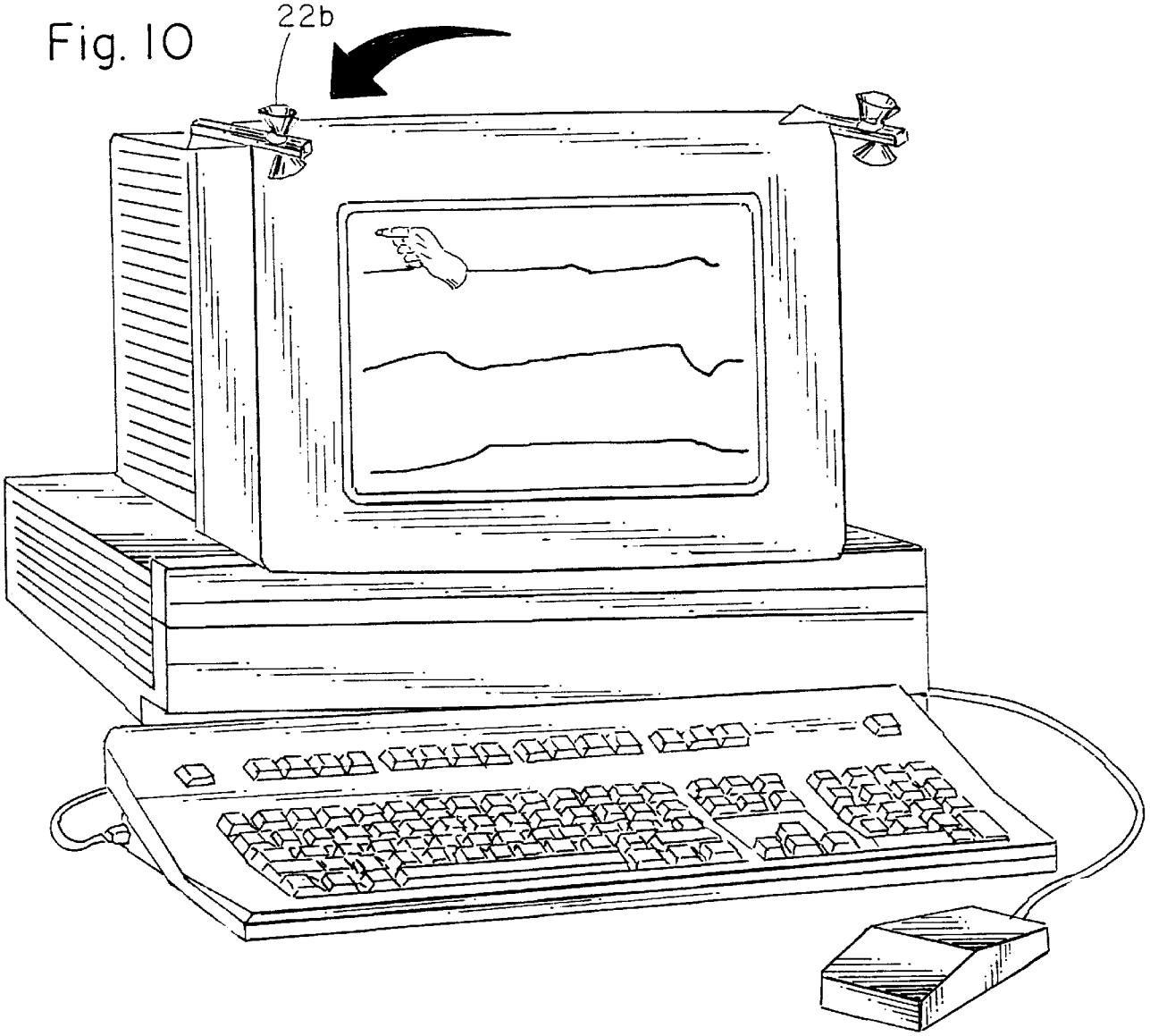
Figure 11:
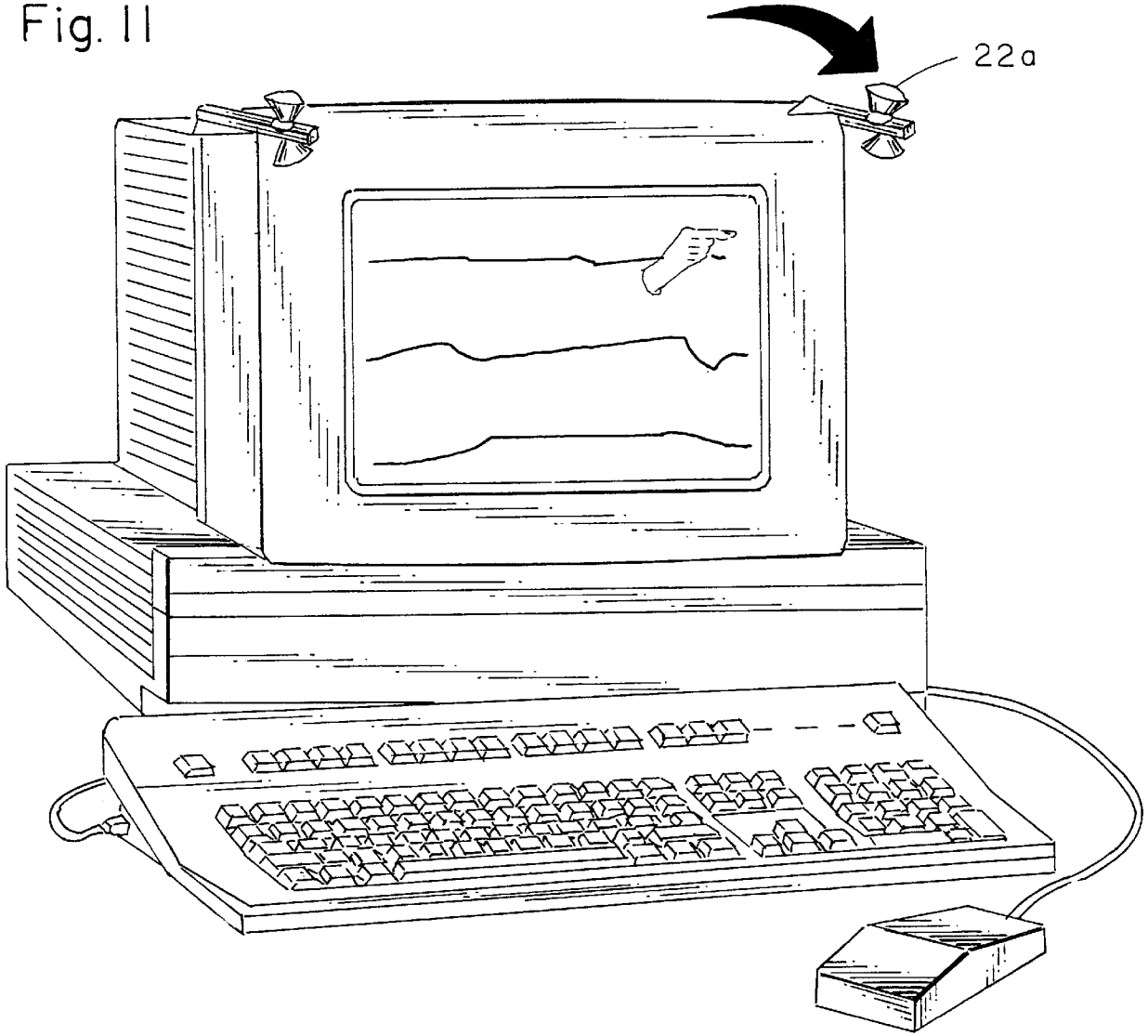

In short, it is the number of keystrokes which primarily directs the operator response and initiates a cycle. As illustrated in FIG. 8, a sequence begins when the right hand is directed to leave the keyboard and contact the right lower target. After an additional set of keystrokes, the left hand is directed to the left lower target (FIG. 9). Then, as illustrated in FIG. 10, the right hand is directed towards and crosses to the left upper target after completion of the third sequence of keystrokes. After completion of the fourth sequence, the left hand contacts the right upper target (FIG. 11).

It should be emphasized that the provided sequence signals are merely examples and may be adapted in either direction (i.e. left-hand to right-hand side contact interface and vise versa). Additionally, the software of the present apparatus and method may be individually programmable by the computer operator or their employer to adjust the signal parameters for their particular health status and work environment.

First Sequence (FIG. 8)

Signal for the right-hand to contact the right-hand side lower contact interface 24*a*.

| | |
|---|---|
| Age C I/Grade 1 | four lines or 300 keystrokes |
| Age C I/Grade 2 | three lines or 225 keystrokes |
| Age C I/Grade 3 | two lines or 150 keystrokes |
| Age C II/Grade 1 | two lines or 150 keystrokes |
| Age C II/Grade 2 | two lines or 150 keystrokes |
| Age C II/Grade 3 | one line or 75 keystrokes |
| Age C III/Grade 1 | one line or 75 keystrokes |
| Age C III/Grade 2 | one line or 75 keystrokes |
| Age C III/Grade 3 | one line or 75 keystrokes |

Second Sequence (FIG. 9)

Signal for the left-hand to contact the left-hand side lower contact interface 24*b*.

| | |
|---|---|
| Age C I/Grade 1 | eight lines or 600 keystrokes |
| Age C I/Grade 2 | six lines or 450 keystrokes |
| Age C I/Grade 3 | four lines or 300 keystrokes |
| Age C II/Grade 1 | four lines or 300 keystrokes |
| Age C II/Grade 2 | four lines or 300 keystrokes |
| Age C II/Grade 3 | two lines or 150 keystrokes |
| Age C III/Grade 1 | two lines or 150 keystrokes |
| Age C III/Grade 2 | two lines or 150 keystrokes |
| Age C III/Grade 3 | two lines or 150 keystrokes |

Third Sequence (FIG. 10)

Signal for the right-hand to contact the left-hand side upper contact interface 22*b*.

| | |
|---|---|
| Age C I/Grade 1 | twelve lines or 900 keystrokes |
| Age C I/Grade 2 | nine lines or 675 keystrokes |
| Age C I/Grade 3 | six lines or 450 keystrokes |
| Age C II/Grade 1 | six lines or 450 keystrokes |
| Age C II/Grade 2 | six lines or 450 keystrokes |
| Age C II/Grade 3 | three lines or 225 keystrokes |
| Age C III/Grade 1 | three lines or 225 keystrokes |
| Age C III/Grade 2 | three lines or 225 keystrokes |
| Age C III/Grade 3 | three lines or 225 keystrokes |

Fourth Sequence (FIG. 11)

Signal for the left-hand to contact the right-hand side upper contact interface 22*a*.

| | |
|---|---|
| Age C I/Grade 1 | sixteen lines or 1200 keystrokes |
| Age C I/Grade 2 | twelve lines or 900 keystrokes |
| Age C I/Grade 3 | eight lines or 600 keystrokes |
| Age C II/Grade 1 | eight lines or 600 keystrokes |
| Age C II/Grade 2 | eight lines or 600 keystrokes |
| Age C II/Grade 3 | four lines or 300 keystrokes |
| Age C III/Grade 1 | four lines or 300 keystrokes |
| Age C III/Grade 2 | four lines or 300 keystrokes |
| Age C III/Grade 3 | four lines or 300 keystrokes |

Non-Keyboard Input Devices

Furthermore, the present invention may be utilized as a prompt and exercise target during use of a mouse or other input device. Since the mouse is the major non-keyboard entry device it will be used to represent all other non-keyboard hand used devices (i.e. trackball, finger pad etc.). Also it is assumed that the mouse is used with the right-hand. Therefore a left-handed computer operator, upon the appropriate signal, would move and contact the right-side target 20*a* (i.e. the target means opposite).

For mouse data entry, the present system is based upon a benchmark unit of 15 seconds of mouse use as the first variable. All other variables (Age and Grade) are unaffected. In relation to mouse use there are only two sequences: right-hand contacts left-sided upper contact interface 22*b* and right-hand contacts left-sided lower contact interface 24. The opposite-side targets are utilized to maximize joint movement because it is felt that fine mouse control may be more dangerous to human tissues than traditional key entry.

First Mouse Sequence

Signal for the mouse-hand (right) to contact the left-hand side upper contact interface 22*b*.

| | |
|---|---|
| Age CI/Grade1 | 60 seconds |
| Age CI/Grade2 | 45 seconds |
| Age C1/Grade3 | 30 seconds |
| Age CII/Grade1 | 30 seconds |
| Age CII/Grade2 | 30 seconds |
| Age CII/Grade3 | 15 seconds |
| Age CIII/Grade1 | 15 seconds |
| Age CIII/Grade2 | 15 seconds |
| Age CIII/Grade3 | 15 seconds |

Second Mouse Sequence

Signal for the mouse-hand (right) to contact the left-hand side lower contact interface 24*b*.

| | |
|---|---|
| Age CI/Grade1 | 120 seconds |
| Age CI/Grade2 | 90 seconds |

-continued

| | |
|---|---|
| Age C1/Grade3 | 60 seconds |
| Age CII/Grade1 | 60 seconds |
| Age CII/Grade2 | 60 seconds |
| Age CII/Grade3 | 30 seconds |
| Age CIII/Grade1 | 30 seconds |
| Age CIII/Grade2 | 30 seconds |
| Age CIII/Grade3 | 30 seconds |

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and methods and the combination and arrangement of parts and method steps may be resorted to without departing from the spirit and scope of the invention.

Now that the invention has been described,

What is claimed is:

1. An apparatus for preventing, lessening and treating repetitive strain injuries, comprising:

a plurality of target means wherein each of said target means comprises an elongate member having a first end and a second end and an upper and a lower surface, wherein said first end is fixedly attached to a computer display monitor and said second end has a plurality of contact interfaces disposed thereon;

computer software which provides a stimulus for a computer operator to remove their limbs from the computer keyboard;

wherein upon receipt of said stimulus a computer operator initiates an exercise pattern utilizing said target means as a trajectory goal.

2. An apparatus for preventing, lessening and treating repetitive strain injuries, comprising:

a plurality of target means wherein each of said target means comprises an elongate member having a first end and a second end and an upper and a lower surface, wherein said first end is fixedly attached to a computer display monitor and said second end has a plurality of contact interfaces disposed thereon;

wherein a right-side target means is fixedly attached to the upper top corner of the right-hand side of the computer display monitor and a left-side target means is fixedly attached to the upper top corner of the left-hand side of the computer display monitor;

computer software which provides a stimulus for a computer operator to remove their limbs from the computer keyboard;

wherein upon receipt of said stimulus a computer operator initiates an exercise pattern utilizing said target means as a trajectory goal.

3. An apparatus for preventing, lessening and treating repetitive strain injuries as in claim 2, wherein said contact interfaces disposed upon said second end of said target means comprise an upper contact interface on said upper surface and a lower contact interface on said lower surface opposite thereof, wherein said contact interfaces are oriented at specific angles which define the trajectory of the movement of the computer operator's limbs when they leaves the keyboard.

4. An apparatus for preventing, lessening and treating repetitive strain injuries as in claim 3, wherein said contact interfaces are pivotally connected to said elongate member.

5. An apparatus for preventing, lessening and treating repetitive strain injuries as in claim 3, wherein said contact interfaces are formed integrally with the elongate member.

6. An apparatus for preventing, lessening and treating repetitive strain injuries as in claim 2, wherein said target means further comprises a counter means.

7. An apparatus for preventing, lessening and treating repetitive strain injuries as in claim 2, wherein said computer software tracks the number of keystrokes made by the computer operator.

8. An apparatus for preventing, lessening and treating repetitive strain injuries as in claim 2, wherein the frequency of said computer generated stimulus is based upon the number of computer keystrokes made by a computer operator, the age of the computer operator and the symptom of the computer operator.

9. A method of preventing, lessening and treating repetitive strain injuries comprising:

obtaining an apparatus for preventing repetitive strain injuries, comprising:

a plurality of target means wherein each of said target means comprises an elongate member having a first end and a second end and an upper and a lower surface, wherein said first end is fixedly attached to a computer display monitor and said second end has a plurality of contact interfaces disposed thereon;

wherein a right-side target means is fixedly attached to the upper top corner of the right-hand side of the computer display monitor and a left-side target means is fixedly attached to the upper top corner of the left-hand side of the computer display monitor;

computer software which provides a stimulus for a computer operator to remove their limbs from the computer keyboard;

wherein upon receipt of said stimulus a computer operator initiates an exercise pattern utilizing said target means as a trajectory goal.

10. A method of preventing, lessening and treating repetitive strain injuries comprising:

obtaining an apparatus for preventing repetitive strain injuries, comprising:

a plurality of target means wherein each of said target means comprises an elongate member having a first end and a second end and an upper and a lower surface, wherein said first end is fixedly attached to a computer display monitor and said second end has a plurality of contact interfaces disposed thereon;

wherein said contact interfaces disposed upon said second end of said target means comprise an upper contact interface on said upper surface and a lower contact interface on said lower surface opposite thereof, wherein said contact interfaces are oriented at specific angles which define the trajectory of the movement of the computer operator's limbs when they leaves the keyboard;

wherein a right-side target means is fixedly attached to the upper top corner of the right-hand side of the computer display monitor and a left-side target means is fixedly attached to the upper top corner of the left-hand side of the computer display monitor;

computer software which provides a stimulus for a computer operator to remove their limbs from the computer keyboard;

wherein upon receipt of said stimulus a computer operator initiates an exercise pattern utilizing said target means as a trajectory goal;

wherein said exercise pattern includes four sequences, each sequence occurring at a set frequency, which direct the movement of one of the operator's hands to a specific target means.

11. The method of preventing, lessening and treating repetitive strain injuries as in claim 10, wherein a first sequence is initiated when the right hand of a computer operator is directed to leave the keyboard and contact said lower contact interface on said right-side target means;

wherein a second sequence is initiated when the left hand of a computer operator is directed to leave the keyboard and contact said lower contact interface on said left-side target means;

wherein a third sequence is initiated when the right hand of a computer operator is directed to leave the keyboard and contact said upper contact interface on said left-side target means; and wherein a fourth sequence is initiated when the left hand of a computer operator is directed to leave the keyboard and contact said upper contact interface on said right-side target means.

12. The method of preventing, lessening and treating repetitive strain injuries as in claim 10, wherein the frequency of said computer generated stimulus is based upon the number of computer keystrokes made by a computer operator, the age of the computer operator and the symptom grade of the computer operator.

13. The method of preventing, lessening and treating repetitive strain injuries as in claim 11, wherein said first sequence is initiated based upon the following frequency:

| | |
|---|---|
| Age C I/Grade 1 | four lines or 300 keystrokes |
| Age C I/Grade 2 | three lines or 225 keystrokes |
| Age C I/Grade 3 | two lines or 150 keystrokes |
| Age C II/Grade 1 | two lines or 150 keystrokes |
| Age C II/Grade 2 | two lines or 150 keystrokes |
| Age C II/Grade 3 | one line or 75 keystrokes |
| Age C III/Grade 1 | one line or 75 keystrokes |
| Age C III/Grade 2 | one line or 75 keystrokes |
| Age C III/Grade 3 | one line or 75 keystrokes. |

14. The method of preventing, lessening and treating repetitive strain injuries as in claim 11, wherein said second sequence is initiated based upon the following frequency:

| | |
|---|---|
| Age C I/Grade 1 | eight lines or 600 keystrokes |
| Age C I/Grade 2 | six lines or 450 keystrokes |
| Age C I/Grade 3 | four lines or 300 keystrokes |
| Age C II/Grade 1 | four lines or 300 keystrokes |
| Age C II/Grade 2 | four lines or 300 keystrokes |
| Age C II/Grade 3 | two lines or 150 keystrokes |
| Age C III/Grade 1 | two lines or 150 keystrokes |
| Age C III/Grade 2 | two lines or 150 keystrokes |
| Age C III/Grade 3 | two lines or 150 keystrokes. |

15. The method of preventing, lessening and treating repetitive strain injuries as in claim 11, wherein said third sequence is initiated based upon the following frequency:

| | |
|---|---|
| Age C I/Grade 1 | twelve lines or 900 keystrokes |
| Age C I/Grade 2 | nine lines or 675 keystrokes |
| Age C I/Grade 3 | six lines or 450 keystrokes |
| Age C II/Grade 1 | six lines or 450 keystrokes |
| Age C II/Grade 2 | six lines or 450 keystrokes |
| Age C II/Grade 3 | three lines or 225 keystrokes |
| Age C III/Grade 1 | three lines or 225 keystrokes |
| Age C III/Grade 2 | three lines or 225 keystrokes |
| Age C III/Grade 3 | three lines or 225 keystrokes. |

16. The method of preventing, lessening and treating repetitive strain injuries as in claim 11, wherein said fourth sequence is initiated based upon the following frequency:

| | |
|---|---|
| Age C I/Grade 1 | sixteen lines or 1200 keystrokes |
| Age C I/Grade 2 | twelve lines or 900 keystrokes |
| Age C I/Grade 3 | eight lines or 600 keystrokes |
| Age C II/Grade 1 | eight lines or 600 keystrokes |
| Age C II/Grade 2 | eight lines or 600 keystrokes |
| Age C II/Grade 3 | four lines or 300 keystrokes |
| Age C III/Grade 1 | four lines or 300 keystrokes |
| Age C III/Grade 2 | four lines or 300 keystrokes |
| Age C III/Grade 3 | four lines or 300 keystrokes. |

17. The method of preventing, lessening and treating repetitive strain injuries as in claim 9, wherein said exercise pattern includes a first and second sequence, based upon the use of a non-keyboard input device, each of said sequences directing the movement of one of the operator's hands to a specific target means.

18. The method of preventing, lessening and treating repetitive strain injuries as in claim 17, wherein a first sequence is initiated when the hand of the computer operator is employing a non-keyboard input device, is directed to leave the non-keyboard input device and contact said upper contact interface disposed on the opposite-side target means, wherein said sequence is based upon the following frequency:

| | |
|---|---|
| Age CI/Grade1 | 60 seconds |
| Age CI/Grade2 | 45 seconds |
| Age C1/Grade3 | 30 seconds |
| Age CII/Grade1 | 30 seconds |
| Age CII/Grade2 | 30 seconds |
| Age CII/Grade3 | 15 seconds |
| Age CIII/Grade1 | 15 seconds |
| Age CIII/Grade2 | 15 seconds |
| Age CIII/Grade3 | 15 seconds. |

19. The method of preventing, lessening and treating repetitive strain injuries as in claim 17, wherein a second sequence is initiated when the hand of the computer operator employing a non-keyboard input device, is directed to leave the non-keyboard input device and contact said lower contact interface disposed on the opposite-side target means, wherein said sequence is based upon the following frequency:

| | |
|---|---|
| Age CI/Grade1 | 120 seconds |
| Age CI/Grade2 | 90 seconds |
| Age C1/Grade3 | 60 seconds |
| Age CII/Grade1 | 60 seconds |
| Age CII/Grade2 | 60 seconds |
| Age CII/Grade3 | 30 seconds |
| Age CIII/Grade1 | 30 seconds |
| Age CIII/Grade2 | 30 seconds |
| Age CIII/Grade3 | 30 seconds. |

* * * * *